US010953281B2

(12) United States Patent
Wei et al.

(10) Patent No.: US 10,953,281 B2
(45) Date of Patent: Mar. 23, 2021

(54) TREADMILL, CONTROL METHOD AND DETECTION MODULE FOR THE SAME

(71) Applicant: PIXART IMAGING INC., Hsin-Chu (TW)

(72) Inventors: Wei-Feng Wei, Hsin-Chu (TW); Chao-Chien Huang, Hsin-Chu (TW); Chi-Yang Huang, Hsin-Chu (TW)

(73) Assignee: PIXART IMAGING INC., Hsin-Chu (TW)

( * ) Notice: Subject to any disclaimer, the term of this patent is extended or adjusted under 35 U.S.C. 154(b) by 50 days.

(21) Appl. No.: 16/153,072

(22) Filed: Oct. 5, 2018

(65) Prior Publication Data

US 2019/0240540 A1 Aug. 8, 2019

Related U.S. Application Data

(60) Provisional application No. 62/626,178, filed on Feb. 5, 2018.

(51) Int. Cl.
*A63B 24/00* (2006.01)
*A63B 22/02* (2006.01)
(Continued)

(52) U.S. Cl.
CPC ..... *A63B 24/0087* (2013.01); *A63B 22/02* (2013.01); *A63B 22/025* (2015.10); *A63B 22/0235* (2013.01); *A63B 24/0062* (2013.01); *A63B 71/0054* (2013.01); *A63B 2024/0093* (2013.01); *A63B 2071/0081* (2013.01); *A63B 2071/065* (2013.01);
(Continued)

(58) Field of Classification Search
CPC ..... A63B 22/025; A63B 22/0257; A63B 22/0278; A63B 22/0285; A63B 22/02; A63B 22/0235; A63B 22/0424; A63B 2022/0278; A63B 24/0087; A63B 2220/805
USPC ..... 482/7
See application file for complete search history.

(56) References Cited

U.S. PATENT DOCUMENTS 8,305,460 B2 * 11/2012 Lu ..... H04N 5/23245 348/222.1
9,028,368 B2 * 5/2015 Ashby ..... A63B 23/0476 482/1
(Continued)

FOREIGN PATENT DOCUMENTS

CN 102058957 A 5/2011
CN 103623540 A 3/2014
(Continued)

OTHER PUBLICATIONS

KR 20030069941 Translation, Aug. 2003.*

*Primary Examiner* — Andrew S Lo
*Assistant Examiner* — Thao N Do
(74) *Attorney, Agent, or Firm* — Li & Cai Intellectual Property (USA) Office

(57) ABSTRACT

A treadmill includes a base including two rest zones and a running zone arranged between the two rest zones; a running track disposed in the running zone of the base enabling a user to exercise thereon; and a detection module. The detection module includes a light emitter emitting light to cover the two rest zones and the running zone, and at least one light sensor detecting a position and a speed of the user according to a reflected light from the user.

21 Claims, 7 Drawing Sheets

(51) Int. Cl.
*A63B 71/00* (2006.01)
*A63B 71/06* (2006.01)

(52) U.S. Cl.
CPC ... *A63B 2071/0677* (2013.01); *A63B 2220/05* (2013.01); *A63B 2220/13* (2013.01); *A63B 2220/30* (2013.01); *A63B 2220/805* (2013.01); *A63B 2220/833* (2013.01); *A63B 2225/74* (2020.08)

(56) References Cited

U.S. PATENT DOCUMENTS

2005/0164839 A1* 7/2005 Watterson ..... A63B 22/0228 482/54
2006/0009333 A1* 1/2006 Wang ..... A63B 22/0257 482/54
2006/0142126 A1* 6/2006 Wilkins ..... A63B 5/20 482/54
2009/0036272 A1* 2/2009 Yoo ..... A63B 24/00 482/7
2010/0210418 A1* 8/2010 Park ..... A63B 22/025 482/4
2013/0267385 A1* 10/2013 Watterson ..... A63B 24/0062 482/8
2015/0009141 A1* 1/2015 Cheng ..... G06F 3/0346 345/158
2015/0196805 A1* 7/2015 Koduri ..... A63B 24/0062 482/6
2016/0213976 A1* 7/2016 So ..... A63B 71/0622
2017/0209734 A1* 7/2017 Huang ..... A63B 22/0017
2017/0225038 A1* 8/2017 Wei ..... A63B 22/0242
2018/0243611 A1* 8/2018 Bradley ..... A63B 71/0054
2019/0224520 A1* 7/2019 Yoo ..... A63B 24/0075
2019/0240540 A1* 8/2019 Wei ..... A63B 24/0087
2019/0351309 A1* 11/2019 Fima ..... A63B 22/02

FOREIGN PATENT DOCUMENTS

CN 106823266 A 6/2017
CN 107029383 A 8/2017
CN 206499812 U 9/2017
KR 20030069941 A * 8/2003

* cited by examiner

TREADMILL, CONTROL METHOD AND DETECTION MODULE FOR THE SAME

CROSS-REFERENCE TO RELATED PATENT APPLICATION

This application claims priority from the U.S. Provisional Patent Application Ser. No. 62/626,178 filed Feb. 5, 2018, which application is incorporated herein by reference in its entirety.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a treadmill, a control method and a detection module for the treadmill, and more particularly to a treadmill, a control method and a detection module for the treadmill adapted to control the speed of a running track based on the speed or position of a runner/user.

BACKGROUND OF THE DISCLOSURE

Fitness has become an important issue for people all around the world, motivating more and more people to form the habit of exercising. The treadmill is one of the most common exercise machines at present. A treadmill of the related art provides functionalities such as speed adjustment, a timer, and various exercise modes so that users can adjust their exercise routine on the treadmill as needed.

In the prior art, when a user wishes to adjust the speed of the running track, manual operation of the control panel on the treadmill is required. However, since the user's physical strength will gradually decrease as the exercise continues, accidents may happen when the user tries but fails to reach the control panel from the farther end of the treadmill belt due to fatigue.

Furthermore, everyone has their own natural way of running. For example, some treadmill users habitually run towards a lateral side of the treadmill belt, which applies uneven pressure to the treadmill and hence is likely to shorten the lifespan of the treadmill after long-term use.

Therefore, one of the primary objectives in the art is to overcome the afore-mentioned shortcomings and provide a durable and safe treadmill.

SUMMARY OF THE DISCLOSURE

In response to the above-referenced technical inadequacies, the present disclosure provides a treadmill, a control method and a detection module for the treadmill, and more particularly to a treadmill, a control method and a detection module for the treadmill adapted to control the speed of a running track based on the speed or position of a user.

In one aspect, the present disclosure provides a treadmill, which includes a base, a running track and a detection module. The base includes two rest zones and a running zone arranged between the two rest zones. The running track is disposed in the running zone of the base enabling a user to exercise thereon. The detection module includes a light emitter and at least one light sensor. The light emitter emits light to cover the two rest zones and the running zone. The at least one light sensor detects a position and a speed of the user according to a reflected light from the user.

In one aspect, the present disclosure provides a control method for a treadmill, adapted to control a running track thereof, the treadmill including a base that includes two rest zones and a running zone arranged between the two rest zones, and a running track disposed in the running zone of the base enabling a user to exercise thereon. The control method includes: emitting light to cover the two rest zones and the running zone using a light emitter; and detecting a position and a speed of the user according to a reflected light from the user using at least one light sensor.

In one aspect, the present disclosure provides a detection module for a treadmill, adapted to obtain a speed of a user thereon. The treadmill includes a base including two rest zones and a running zone arranged between the two rest zones and a running track disposed in the running zone of the base enabling the user to exercise thereon, and the detection module includes a light emitter and at least one light sensor. The light emitter emits light to cover the two rest zones and the running zone. The at least one light sensor detects a position and a speed of the user according to a reflected light from the user.

Specifically, the treadmill, the control method and the detection module for the treadmill of the present disclosure can adjust the speed of the treadmill according to whether the user is running on the near zone or the far zone of the running zone, such that the user can remain running in the middle zone of the running track, thereby providing automatic adjustment of the running track without the user having to manually operate the treadmill to ensure the safety thereof.

Furthermore, the treadmill, the control method and the detection module for the treadmill of the present disclosure can adjust the speed of the treadmill according to the speed of the user, such that the user can remain running in the preset speed, thereby providing automatic adjustment of the running track without the user having to manually operate the treadmill to ensure the safety thereof.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
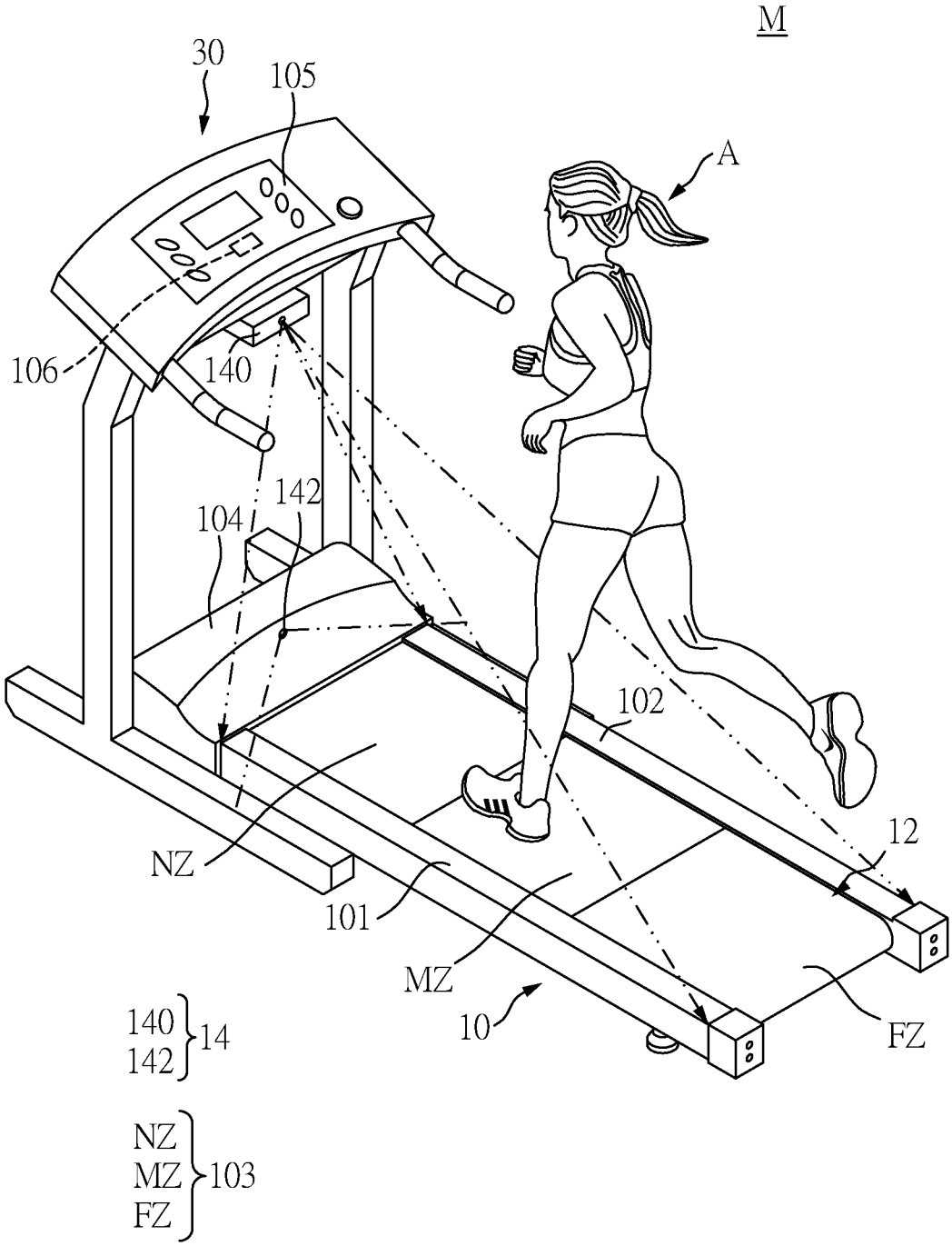
FIG. 1 is a schematic diagram illustrating a treadmill according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

The present invention relates to a treadmill, which is adapted to control the speed of a running track based on an operator's (runner) speed or position. The present disclosure uses a light sensor to detect a position of a runner on the treadmill and correspondingly controls the operating status of the treadmill, i.e., speed of a running track on the treadmill.

Reference is now made to FIG. 1, a first embodiment of the present disclosure provides a treadmill M, which includes a base 10, a running track 12 and a detection module 14. The running track 12 is disposed in the running zone 103 of the base 10 enabling a user A to exercise thereon. Specifically, the base 10 may include a motor for rotating the running track 12, such that the user A can jog or run on the running track 12, other similar mechanisms may also be used for rotating the running track 12. The motor and its related components may be accommodated in a solid case 104.

The base 10 further includes two rest zones 101 and 102 and a running zone 103 arranged between the two rest zones 101 and 102. The two rest zones 101 and 102 may be disposed at two sides of the running track 12, which provide flat and stable surfaces for enabling the user A to stand on the rest zones 101 and 102 to take a rest.

Furthermore, the detection module 14 may include a light emitter 140 and a light sensor 142. As shown in FIG. 1, the light emitter 142 may be fixed on the solid case 104 and emit light to cover the two rest zones 101, 102 and the running zone 103, and the light sensor 140 detects a position and a speed of the user A according to a reflected light from the user A. Specifically, a sensing field of view of the light sensor 140 may include the rest zones 101, 102 and the running zone 103. In the present disclosure, the light sensor 140 may be an image sensor, such as CMOS or CCD, or may include a plurality of photodiodes. Specifically, the light sensor 140 is configured to obtain a captured image including at least one object image indicating position of the user A.

The light emitter 142 is further provided to enhance the light sensor 140 to detect the object image in the captured images. The light emitter 142 may be a single light source or a plurality of light sources, which may emit a uniform light or a specific pattern, such as parallel strips. Preferably, the light emitter 142 is configured to emit light in a limited angle which is substantially parallel to the running track. In one embodiment, the light emitter may be an IR LED or laser.

When an incident light travels to a part of the body of the user A, such as legs or shoes, the incident light will be scattered, diffused, and reflected, and the light sensor 140 may detect image by receiving the scattered light, diffused light, and reflected light and obtain the captured image. Since the sensing field of view of the light sensor 140 may include the rest zones 101, 102 and the running zone 103, at least one object image may be further detected in the captured image. Specifically, the object image could be a dot or a group of strips depends on the type of light emitted from the light emitter 142. In addition, the feature of the at least one object image includes at least one of a size and a variation frequency of a pattern.

Figure 2A:
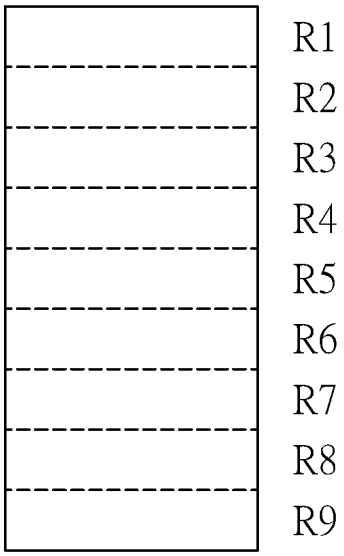
FIGS. 2A and 2B are 1-dimensional and 2-dimensional images of captured images according to the first embodiment of the present disclosure.
Figure 2B:
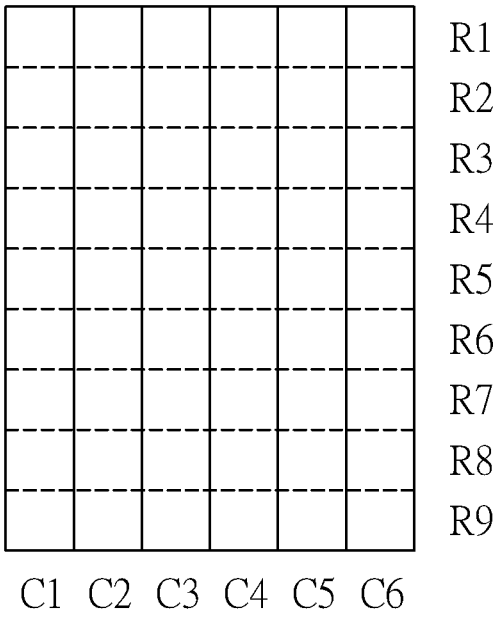

In more detail, the light sensor 140 obtains a captured image including at least one object image indicating position of the user A, and the captured image could be formed as a 2D image or an 1D image, as shown in FIGS. 2A and 2B.

In the present embodiment, the treadmill M may further include a control unit 106 coupled to the detection module 14 and configured to adjust the speed of the running of the running track according to the position or the speed of the user. The control unit 106 may be disposed in a control panel 105 and provides the user with information such as the running rate, running time or warnings. Specifically, the light sensor may include one or more processors or microcontrollers for processing and identifying the object image in the captured image. When the light sensor 140 identifies the at least one object image in the captured image, the light sensor 140 generates information related to the object images for the control unit 106 to adjust the speed of the running track 12. In the present embodiment, the light sensor 140 outputs position and speed information to the control unit 106 after characteristic properties of the object image of the captured image is calculated. In other embodiments, the control unit 106 may also include an image-processing unit for receiving the captured image and calculating the characteristic properties of the object image according to the captured image. The control unit 106 may further be configured to adjust the speed of the running track 12 according to the characteristic properties of the object image accordingly.

Figure 3:
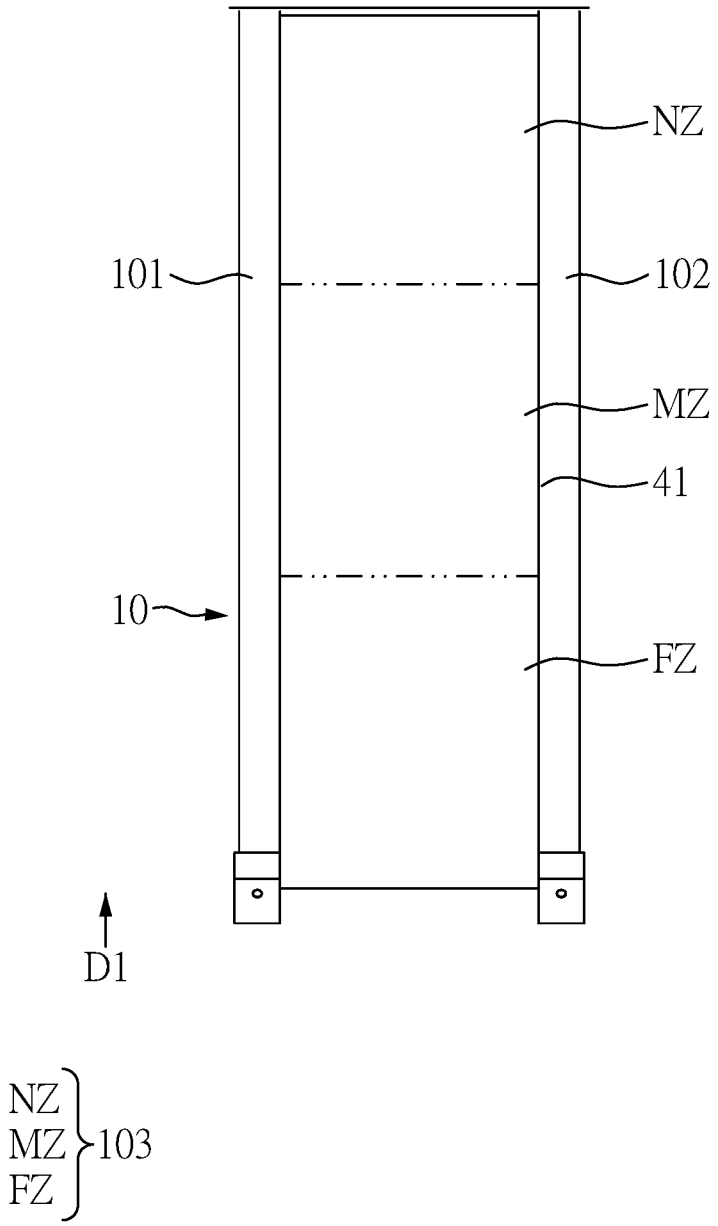
FIG. 3 is a top view of a field of view of a light sensor according to the first embodiment of the present disclosure.

Reference is further made to FIG. 3, which is a top view of a field of view of the light sensor according to the first embodiment of the present disclosure. As shown in FIG. 3, the running zone 103 may be divided into several zones, and when the light sensor 140 identifies which zone the user A is located, the control unit 106 may control the speed of the running track 12 directly. For example, the running track 12 may be divided into three zones, near zone NZ, middle zone MZ, and far zone FZ with respect to positions on the running zone 103 along a running direction D1 of the user. It should be noted that the first row R1 and the neighboring rows correspond to a region of the running track 12 that is near the front of the treadmill M in the example of the 1D image and 2D image, such as the near zone NZ in FIG. 3. In other embodiment, the three zones could only correspond to particular rows in the captured image, such as rows R1-R3 corresponding to near zone NZ, rows R4-R6 corresponding to middle zone MZ, and rows R7-R9 corresponding to far zone FZ.

The present embodiment further provides several cases for the control unit 106 to adjust the speed of the running track 12 according to the position of the user A. For example, when the light sensor 140 detects that the user A is located at the near zone NZ, the control unit 106 may be configured to accelerate the running track 12; when the light sensor 140 detects that the user A is located at the middle zone MZ, the control unit 106 may be configured to maintain the speed of the running track 12. When the light sensor 140 detects that the user A is located at the far zone FZ, the control unit 106 may be configured to deaccelerate the running track 12. On the other hand, if the light sensor 106 detects that the user is located at one or both of the two rest zones 101 and 102, the control unit 106 may be configured to stop the running track 12.

Specifically, the treadmill and the detection module for the same of the present disclosure can adjust the speed of the treadmill according to whether the user is running on the near zone or the far zone of the running zone, such that the user can remain running in the middle zone of the running track, thereby providing automatic adjustment of the running track without the user having to manually operate the treadmill to ensure the safety thereof.

In other embodiments, the light sensor 140 may further identify which zone the user A is located by identifying a feature of the object image in the captured image, such as pattern width, size of a dot, frequency, etc. For example, if patterns provided by the light emitter 142 include parallel strips, the light sensor may be configured to detect the position and the speed according to parallel strip patterns reflected from the user A. In similar ways, the light emitter 142 may be configured to emit light with different features, such as different patterns, wavelengths, or frequencies to assist the light sensor 142 to identify the speed or position of the user A.

Figure 4:
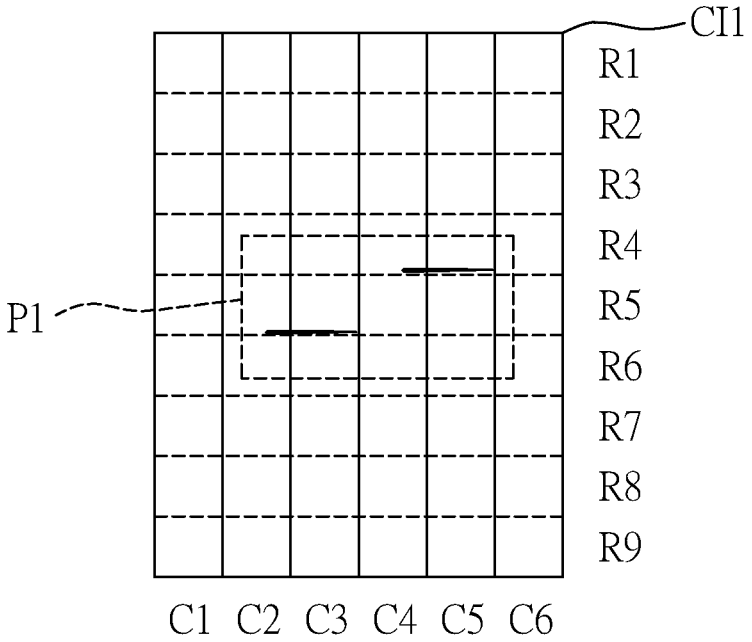
FIG. 4 shows object images of captured images according to the first embodiment of the present disclosure.
Figure 4:
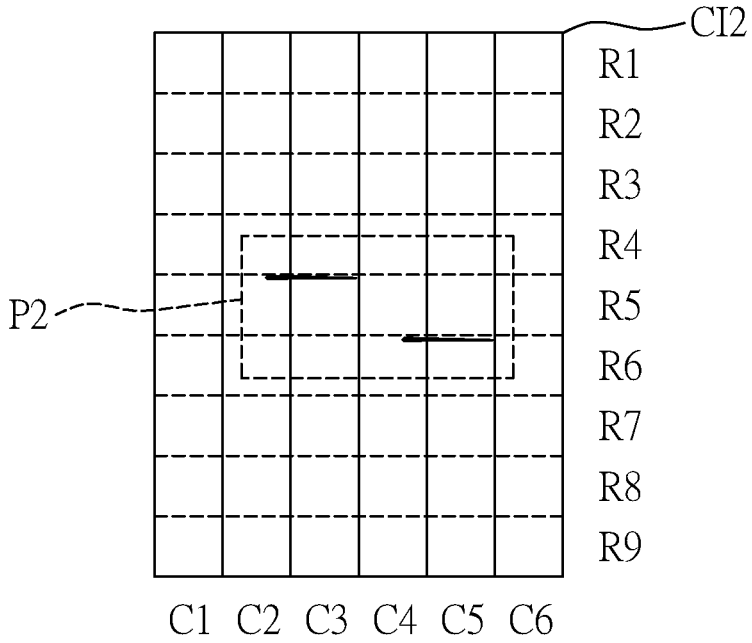

Reference is now made to FIG. 4, in this embodiment, when the light sensor 140 captures and identifies object images P1 and P2 in the captured images CI1 and CI2, respectively, the light sensor 140 could provide information relating to the object images P1/P2 to the control unit to control the speed of the running track 12. For example, the speed of the user A may be obtained by measuring a distance between the left pattern in the object image P1 and the left pattern in the object image P2, and dividing the distance by a time interval between the times for capturing the captured images CI1 and CI2. The control unit 106 further compares the speed of the user A with a preset speed, for example, the preset speed set by the user A, so as to adjust the speed of the running track 12. The control unit 106 is also capable of displaying the speed of the user A obtained by the light sensor 140 or providing the speed to a remote server.

Therefore, the treadmill and the detection module for the same of the present disclosure can adjust the speed of the treadmill according to the speed of the user, such that the user can remain running in the preset speed, thereby providing automatic adjustment of the running track without the user having to manually operate the treadmill to ensure the safety thereof.

Second Embodiment

A control method for the treadmill of the present disclosure will be described in detail hereinafter while making reference to the accompanying drawings. In the present embodiment, the control method for the treadmill is mainly applicable to the first embodiment, but is not limited thereto, and the present embodiment may be implemented in various manners that may be conceived by those skilled in the art. The method provided by the present embodiment may also applicable to any of the embodiments described above.

The method according to the above-described embodiments may be implemented by using computer-executed instructions stored or otherwise accessible from a computer-readable medium. Such instructions may include, for example, instructions and data that cause or otherwise configure a general purpose computer, a special purpose computer, or a special purpose processing device to perform a certain function or set of functions. Parts of the computer resources used can be accessed via the Internet. The computer executable instructions may be, for example, binary, intermediate format instructions such as assembly language, firmware, or source code. Examples of computer-readable media that may be used to store instructions, information used, and/or information created during a method in accordance with the described embodiments include a magnetic or optical disk, flash memory, non-volatile memory USB memory devices, networked storage devices, and more.

In addition, devices for implementing the methods provided by the present disclosure may include hardware, firmware, and/or software, and may be in any of a variety of configurations. Typical examples of such configurations include laptops, smart phones, small personal computers, personal digital assistants, and the like. The functions described herein may also be implemented in peripheral devices or built-in cards. By way of further example, such functions may also be implemented on circuit boards executing different processes on different chips or on a single device.

Figure 5:
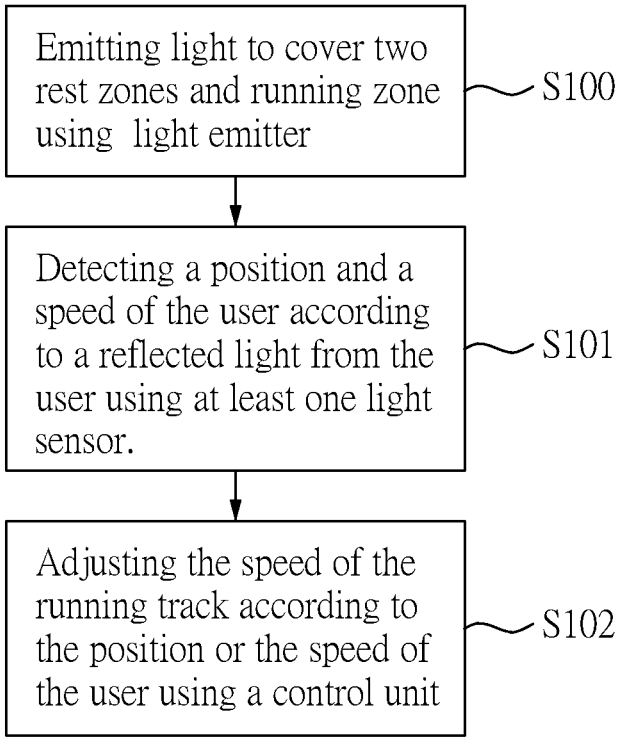
FIG. 5 is a flow chart illustrating the control method for the treadmill according to a second embodiment of the present disclosure.

The control method for controlling the running track 12 of the treadmill M will be explained below. With reference to FIG. 5, the control method in FIG. 5 is applicable to the treadmill M shown in FIG. 1. Specifically, the control method is mainly adapted to control the running track 12 of the treadmill M. As depicted in FIG. 1, the treadmill M includes a base 10 including two rest zones 101, 102 and a running zone 14 arranged between the two rest zones 101, 102, and a running track 12 disposed in the running zone 14 of the base 10 enabling the user A to exercise thereon, the control method including the following steps:

Step 100: emitting light to cover the two rest zones and the running zone using a light emitter.

Step 101: detecting a position and a speed of the user according to a reflected light from the user using at least one light sensor.

Step 102: adjusting the speed of the running track according to the position or the speed of the user using a control unit.

Figure 6:
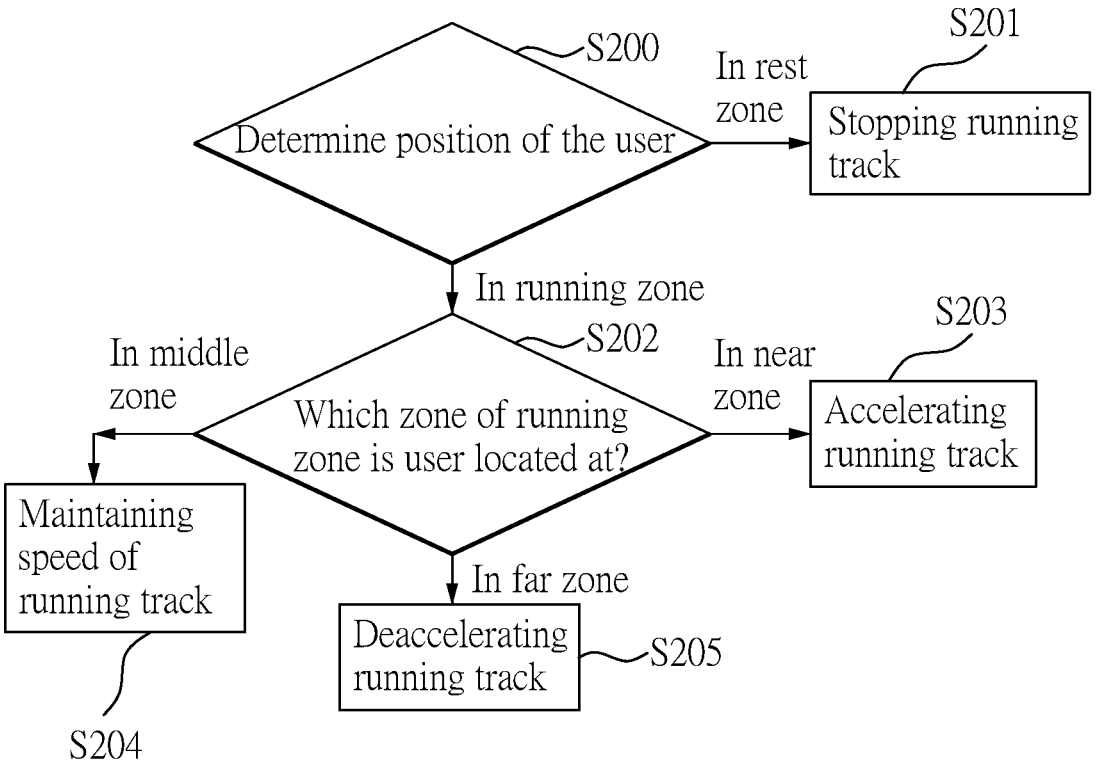
FIG. 6 shows a flowchart illustrating further details in steps S101 and S102.

Reference is now made to FIG. 6, which shows a flowchart illustrating steps S101 and S102 in further detail.

In step S200, the light sensor 140 is further configured to determine the position of the user, if the light sensor 140 detects that the user A is located at the two rest zones, 101 and 102, the method proceeds to step S201, stopping the running track using the control unit.

If the light sensor 140 detects that the user A is located at the running zone 14, the method proceeds to step S202, the light sensor 140 is further configured to determine which zone of the running zone 14 is the user A located at. For example, the running zone is divided into a near zone, a middle zone and a far zone with respect to a position of the running zone along a running direction of the user, as mentioned in the first embodiment.

If the light sensor 140 detects that the user A is located at the near zone NZ, the method proceeds to step S203, accelerating the running track 12 using the control unit 106.

If the light sensor 140 detects that the user A is located at the middle zone MZ, the method proceeds to step S204, maintaining the speed of the running track 12 using the control unit 106.

If the light sensor 140 detects that the user A is located at the far zone FZ, the method proceeds to step S205, deaccelerating the running track 12 using the control unit 106.

Specifically, the control method for the treadmill of the present disclosure can adjust the speed of the treadmill according to whether the user is running on the near zone or the far zone of the running zone, such that the user can remain running in the middle zone of the running track, thereby providing automatic adjustment of the running track without the user having to manually operate the treadmill to ensure the safety thereof.

Figure 7:
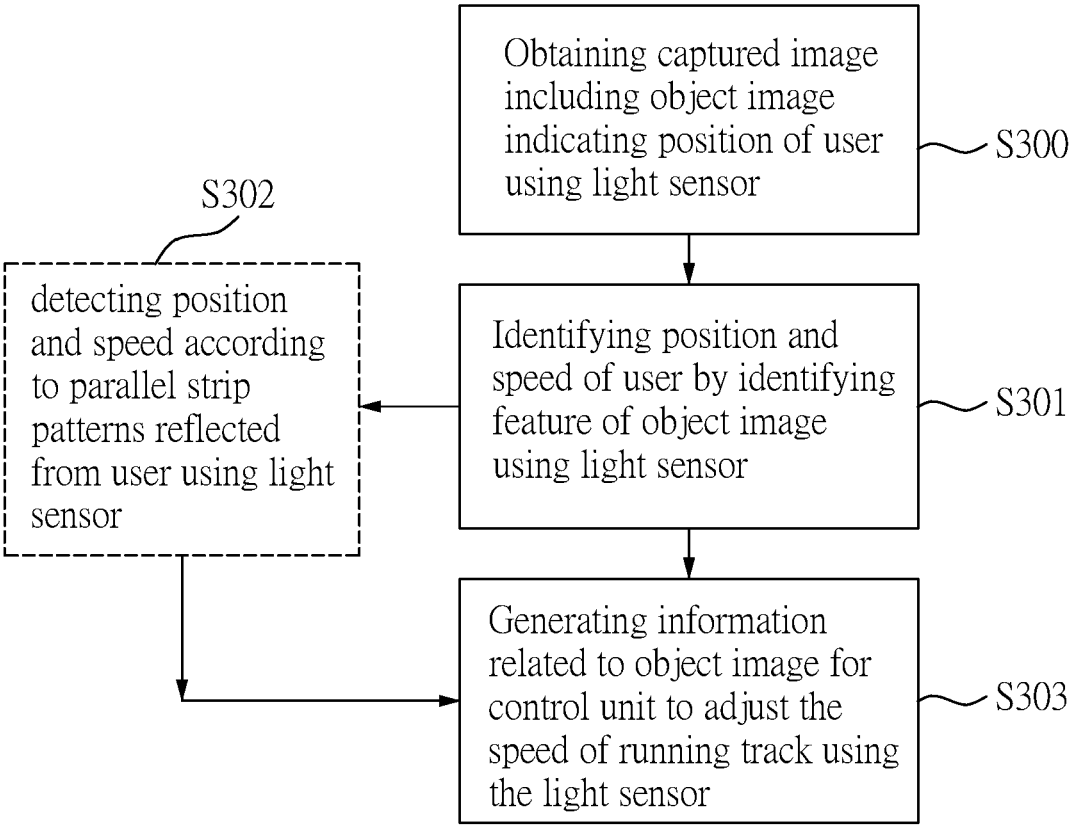
FIG. 7 shows a flowchart illustrating further details in steps S101.

Reference is now made to FIG. 7, which shows a flowchart illustrating steps S101 in further detail. As shown in FIG. 7, the control method further includes the following steps:

Step S300, obtaining a captured image including an object image indicating the position of the user using the light sensor 140.

Step S301, identifying the position and the speed of the user A by identifying a feature of the at least one object image using the light sensor 140. In this case, the feature of the object image may include a size or a variation frequency of a pattern including parallel strips.

Preferably, the method may selectively proceed to step S302, detecting the position and the speed according to parallel strip patterns reflected from the user using the light sensor 140.

Step S302, generating information related to the object images for the control unit 106 to adjust the speed of the running track using the light sensor 140.

Furthermore, the exemplary mechanism for controlling the speed of the running track 12 is depicted in the first embodiment related to FIG. 4, and thus the repeated descriptions are omitted.

In conclusion, the control method for the treadmill of the present disclosure can further adjust the speed of the treadmill according to the speed of the user, such that the user can remain running in the preset speed, thereby providing automatic adjustment of the running track without the user having to manually operate the treadmill to ensure the safety thereof.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A treadmill, comprising:

a base including two rest zones and a running zone arranged between the two rest zones;

a running track disposed in the running zone of the base enabling a user to exercise thereon; and a detection module, including:

a light emitter that emits light to cover the two rest zones and the running zone; and at least one light sensor detecting a position and a speed of the user according to a reflected light from the user, wherein the at least one light sensor detects the speed of the user according to a reflected light from legs of the user in the running zone, wherein the at least one light sensor obtains a first captured image and a second captured image, captures and identifies a first object image in the first captured image and a second object image in the second captured image, and obtains a first pattern and a second pattern from the first object image and a third pattern and a fourth pattern from the second object image, wherein the at least one light sensor further obtains the speed of the user according to a distance between the first pattern at a first side of the first object image and the third pattern at a second side of the second object image, wherein the first side positionally corresponds to the second side.

2. The treadmill according to claim 1, further including a control unit coupled to the detection module and configured to adjust a speed of the running track according to the position or the speed of the user.

3. The treadmill according to claim 2, wherein when the at least one light sensor detects that the user is located at the two rest zones, the control unit stops the running track.

4. The treadmill according to claim 2, wherein the at least one light sensor includes an image sensor or a plurality of photo diodes for obtaining the first and second captured images, the first and second captured images respectively includes the first and second object images indicating the position of the user, and wherein when the at least one light sensor identifies the first and second object images in the first and second captured images, the light sensor generates information related to the object images for the control unit to adjust the speed of the running track.

5. The treadmill according to claim 4, wherein the at least one light sensor identifies the position of the user by identifying a first feature of the first object image or a second feature of the second object image.

6. The treadmill according to claim 2, wherein the running zone is divided into a near zone, a middle zone and a far zone with respect to a position of the running zone along a running direction of the user, and wherein when the at least one light sensor detects that the user is located at the near zone, the control unit accelerates the running track;

wherein when the at least one light sensor detects that the user is located at the middle zone, the control unit maintains the speed of the running track; and wherein when the at least one light sensor detects that the user is located at the far zone, the control unit deaccelerates the running track.

7. The treadmill according to claim 1, wherein the light emitter emits the light in an incident direction substantially parallel to the running track or emits a uniform light.

8. The treadmill according to claim 7, wherein after the light emitter emits light in the incident direction parallel to the running track the at least one light sensor detects the position and the speed according to parallel strip patterns reflected from the user.

9. A control method for a treadmill, adapted to control a running track thereof, wherein the treadmill includes a base including two rest zones and a running zone arranged between the two rest zones and a running track disposed in the running zone of the base enabling a user to exercise thereon, the control method comprising:

emitting light to cover the two rest zones and the running zone using a light emitter;

detecting a position and a speed of the user according to a reflected light from the user using at least one light sensor, wherein the at least one light sensor detects the speed of the user according to a reflected light from legs of the user in the running zone;

obtaining a first captured image and a second captured image by using the at least one light sensor;

capturing and identifying a first object image in the first captured image and a a second object image in the second captured image by using the at least one light sensor;

obtaining a first pattern and a second pattern from the first object image and a third pattern and a fourth pattern from the second object image by using the at least one light sensor; and obtaining the speed of the user according to a distance between the first pattern at a first side of the first object image and the third pattern at a second side of the second object image by using the at least one light sensor, wherein the first side positionally corresponds to the second side.

10. The control method according to claim 9, further including: adjusting a speed of the running track according to the position or the speed of the user using a control unit.

11. The control method according to claim 10, wherein when the at least one light sensor detects that the user is located at the two rest zones, stopping the running track using the control unit.

12. The control method according to claim 10, wherein the at least one light sensor includes an image sensor or a plurality of photo diodes for obtaining the first and second captured images, the first and second captured images respectively includes the first and second object images indicating the position of the user, and wherein when the at least one light sensor identifies the first and second object images in the first and second captured images, the control method further comprises generating information related to the object images for the control unit to adjust the speed of the running track using the light sensor.

13. The control method according to claim 12, further comprising:

identifying the position of the user by identifying a first feature of the first object image or a second feature of the second object image.

14. The control method according to claim 10, wherein the running zone is divided into a near zone, a middle zone and a far zone with respect to a position of the running zone along a running direction of the user, and wherein when the at least one light sensor detects that the user is located at the near zone, accelerating the running track using the control unit;

wherein when the at least one light sensor detects that the user is located at the middle zone, maintaining the speed of the running track using the control unit; and wherein when the at least one light sensor detects that the user is located at the far zone, deaccelerating the running track using the control unit.

15. The control method according to claim 9, wherein the light emitter emits the light in an incident direction substantially parallel to the running track or emits a uniform light.

16. The control method according to claim 9, wherein after the light emitter emits the light in the incident direction parallel to the running track the control method further comprising detecting the position and the speed according to parallel strip patterns reflected from the user using the at least one light sensor.

17. A detection module for a treadmill, adapted to obtain a speed of a user on a treadmill, wherein the treadmill includes a base including two rest zones and a running zone arranged between the two rest zones and a running track disposed in the running zone of the base enabling the user to exercise thereon, the detection module comprising:

a light emitter emitting light to cover the two rest zones and the running zone; and at least one light sensor detecting a position and a speed of the user according to a reflected light from the user, wherein the at least one light sensor detects the speed of the user according to a reflected light from legs of the user in the running zone, wherein the at least one light sensor obtains a first captured image and a second captured image, captures and identifies a first object image in the first captured image and a second object image in the second captured image, and obtains a first pattern and a second pattern from the first object image and a third pattern and a fourth pattern from the second object image, wherein the at least one light sensor further obtains the speed of the user according to a distance between the first pattern at a first side of the first object image and the third pattern at a second side of the second object image, wherein the first side positionally corresponds to the second side.

18. The detection module according to claim 17, wherein the at least one light sensor includes an image sensor or a plurality of photo diodes for obtaining the first and second captured images, the first and second captured images respectively includes the first and second object images indicating the position of the user, and wherein when the at least one light sensor identifies the first and second object images in the first and second captured images, the light sensor generates information related to the object images.

19. The detection module according to claim 18, wherein the at least one light sensor identifies the position and/or the speed of the user by identifying a feature of the at least one object image.

20. The detection module according to claim 17, wherein the light emitter emits the light in an incident direction substantially parallel to the running track or emits a uniform light.

21. The detection module according to claim 20, wherein after the light emitter emits the light in the incident direction parallel to the running track the at least one light sensor detects the position and the speed according to parallel strip patterns reflected from the user.

* * * * *